US005250013A

United States Patent [19]

Brangi

[11] Patent Number: 5,250,013

[45] Date of Patent: Oct. 5, 1993

[54] EXERCISE MACHINE

[76] Inventor: John Brangi, 73 Hillside Ave., New Haven, Conn. 06512

[21] Appl. No.: 2,468

[22] Filed: Jan. 8, 1993

Related U.S. Application Data

[63] Continuation-in-part of Ser. No. 825,028, Jan. 24, 1992, Pat. No. 5,184,991.

[51] Int. Cl.[5] ..... A63B 21/06

[52] U.S. Cl. ..... 482/98; 482/99; 482/137; 482/908

[58] Field of Search ..... 482/62, 97-103, 482/104, 106, 108, 133-139, 908

[56] References Cited

U.S. PATENT DOCUMENTS

| | | | |
|---|---|---|---|
| 2,921,791 | 1/1960 | Berne . | |
| 3,112,108 | 11/1963 | Hanke . | |
| 4,188,030 | 2/1980 | Hooper . | |
| 4,247,098 | 1/1981 | Brentham | 482/137 X |
| 4,509,742 | 4/1985 | Cones . | |
| 4,509,746 | 4/1985 | Mask . | |
| 4,546,968 | 10/1985 | Silberman . | |
| 4,546,970 | 10/1985 | Mask | 482/99 X |
| 4,605,221 | 8/1986 | D'Agosta . | |
| 4,614,338 | 9/1986 | Castillo | 482/98 |
| 4,616,825 | 10/1986 | Anderson . | |
| 4,621,810 | 11/1986 | Cummins . | |
| 4,627,619 | 12/1986 | Rockwell et al. . | |
| 4,634,127 | 1/1987 | Bockwell | 482/98 X |
| 4,645,200 | 2/1987 | Hix . | |
| 4,721,303 | 1/1988 | Fitzpatrick | 482/99 X |
| 4,813,666 | 3/1989 | Costilow et al. . | |
| 4,883,269 | 11/1989 | Shaver . | |
| 4,962,925 | 10/1990 | Chang . | |
| 5,058,884 | 10/1991 | Fuller, Sr. | 482/137 X |
| 5,066,003 | 11/1991 | Jones . | |
| 5,098,361 | 3/1992 | Danylieko . | |
| 5,184,991 | 2/1993 | Brangi | 482/97 |

FOREIGN PATENT DOCUMENTS

| | | | |
|---|---|---|---|
| 3532445 | 3/1987 | Fed. Rep. of Germany | 482/97 |

*Primary Examiner*—Robert Bahr
*Attorney, Agent, or Firm*—Delio & Peterson

[57] ABSTRACT

An exercise device comprises a frame having a seat mounted thereon and a pair of handlebars extending upwardly from and pivotally attached to the frame at a point forward of the seat, each of the handlebars being individually moveable back and forth by the arms of a user of the device. A foot pedal is mounted to and extends rearwardly from each of the handlebars, each foot pedal being individually moveable down and up by the legs of a user of the device. The exercise device includes a pair of weight supporting frames, each of the frames having at least one vertically extending elongated member rigidly connected thereto. Each frame also includes a plurality of weights slidably mounted upon the elongated member. The exercise device further includes a linkage means between each of the handlebars and selected weights within a corresponding weight support frame. The linkage means permits the selected weights to be raised and lowered by respective back and forth movement of the handlebars. The user when seated on the seat may exercise his individual arms and/or legs against resistance of raising and lowering selected weights by respective movement of the individual handlebars in a back and forth direction and individual foot pedals in a down and up direction.

21 Claims, 11 Drawing Sheets

FIG. 2
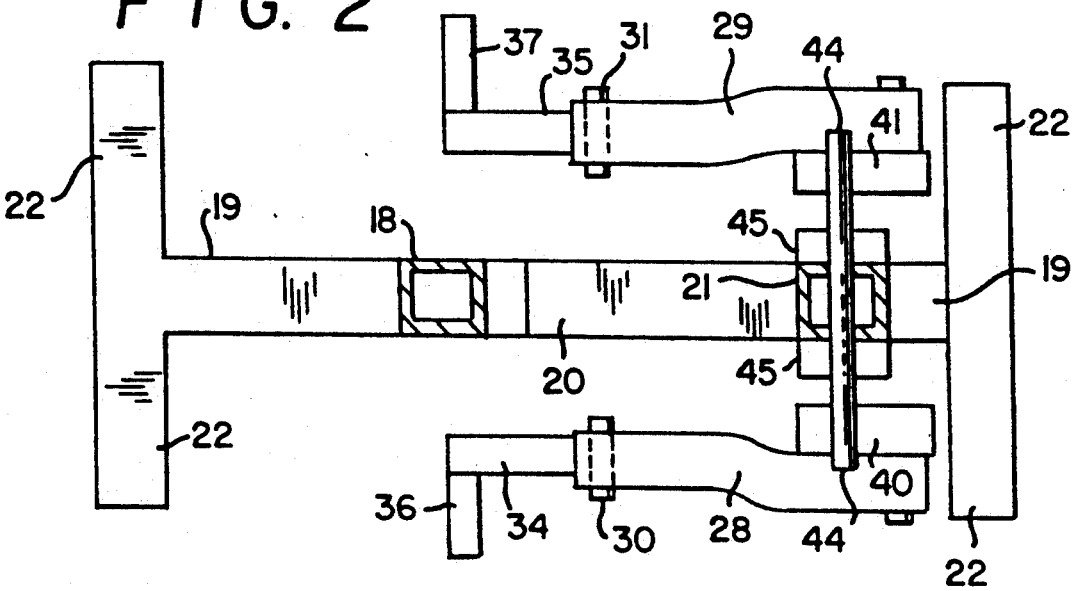
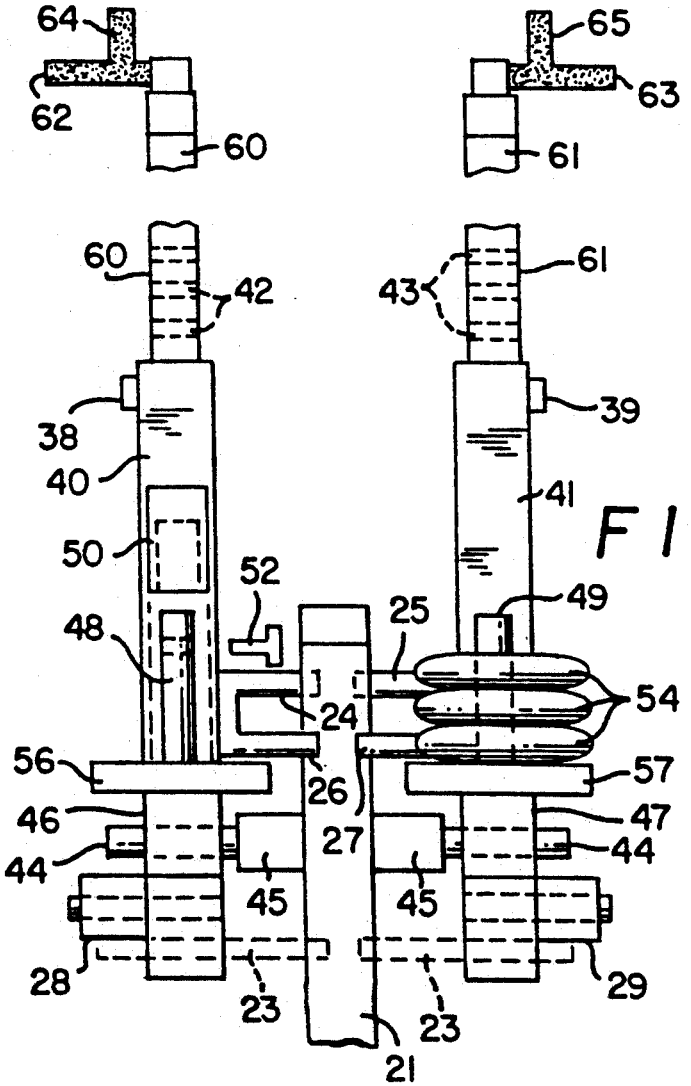
FIG. 3

FIG. 5
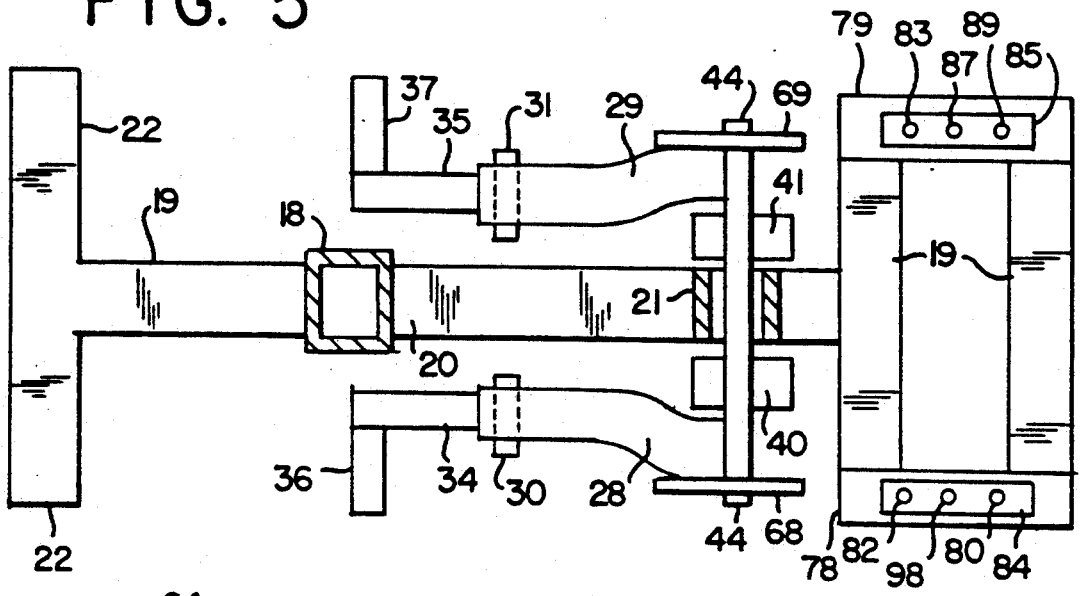
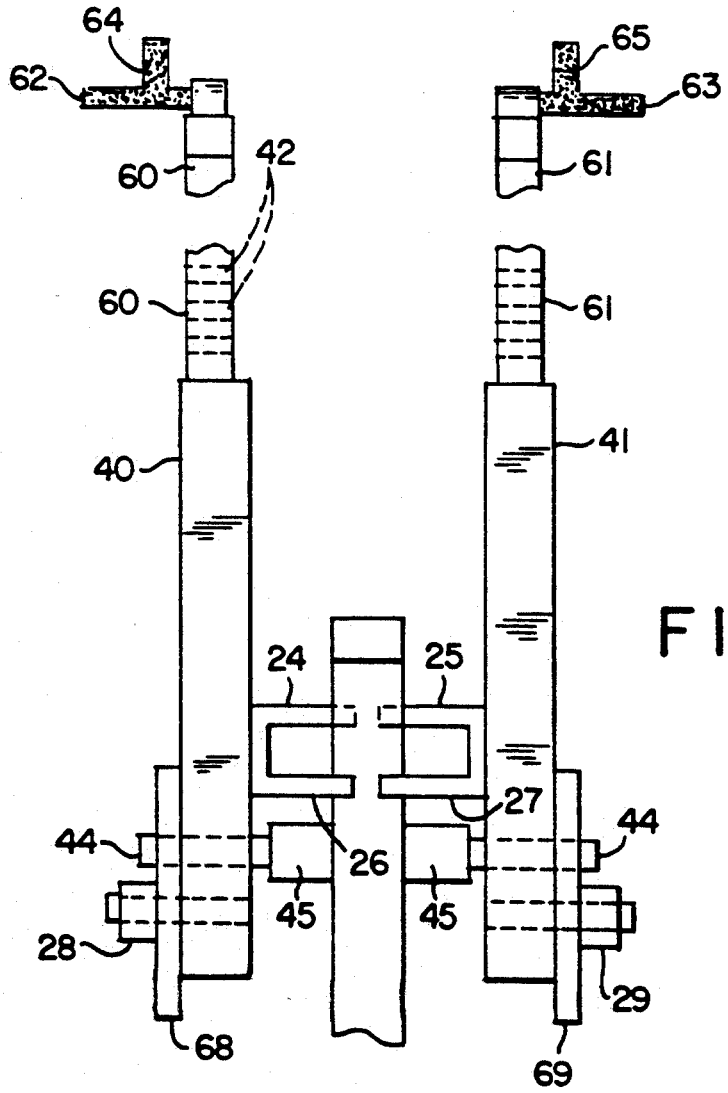
FIG. 6

EXERCISE MACHINE

This is a continuation-in-part of U.S. Ser. No. 825,028, filed Jan. 24, 1992, now U.S. Pat. No. 5,184,991.

BACKGROUND OF THE INVENTION

1. Field of the Invention

The present invention is directed to an exercise device, in particular, to a device which exercises the arms and/or legs of a person.

2. Description of Related Art

Bicycle type exercise devices are popular because they provide a good seating arrangement for exercising a person's legs, generally through resistance applied to rotation of the crank on which the foot pedals are mounted. Some bicycle type exercise devices also provide for simultaneous exercise of the arms as illustrated by U.S. Pat. Nos. 4,188,030 and 4,962,925. Both of these devices have interconnected handlebars and foot pedals which provide for simultaneous opposing motion of the arms and legs on each side of the user's body.

It is desirable to be able to exercise one's arms and/or legs individually on each side of the body, as an alternative to simultaneous (usually opposing) exercise of both arms and/or legs. Also, it would be desirable to be able to set the resistance independently for each side of the body. This would permit individual attention to the various muscle groups of the body according to the needs of the user. Prior art bicycle type exercise devices have not provided for such independently selected resistance to the arms and/or legs on each side of the body. Furthermore, it is desirable for the device to provide a constant resistance to motion, such as that achieved by lifting weights, and for the user to be able to utilize the individual barbell type weights which he or she may already own. Prior art bicycle type exercise devices have not provided for such.

Bearing in mind the problems and deficiencies of the prior art, it is therefore an object of the present invention to provide an exercise device in which the user is able to individually and independently exercise the arms and/or legs on each side of his body.

It is another object of the present invention to provide an exercise device which utilizes the principle of lifting weights against gravity to provide resistance to movement.

It is a further object of the present invention to provide an exercise device which utilizes individual weights of the type employed with barbells to provide resistance.

It is a further object of the present invention to provide an exercise device which utilizes stacked weight plates slidably disposed within weight support frames.

It is yet another object of the present invention to provide an exercise device meeting one or more of the above objects which utilizes bicycle type seating.

It is a further object of the present invention to provide an exercise device meeting one or more of the above objects which is relatively simple and low cost in manufacture.

SUMMARY OF THE INVENTION

The above and other objects, which will be apparent to those skilled in the art, are achieved in the present invention which is directed to an exercise device which comprises a frame having a seat mounted thereon and a pair of handlebars having handgrips thereon extending rearwardly and/or upwardly from and pivotally attached to the frame at a point forward of and/or below the seat, each of the handlebars being individually moveable back and forth by the arms of a user of the device. A weight platform which extends forward from the handlebar pivot point is rigidly connected to each of the handlebars for supporting individual weights. The weight platform is raised and lowered in an arc around the pivot point upon back and forth movement of the handlebars. Means are provided on the device for limiting movement of each of the handlebars between defined forward and back limits.

The user, when seated on the seat, may exercise his individual arms against resistance of raising and lowering selected weights on the weight platform by grasping the handgrips with his hands for respective opposite movement of the individual handlebars in a back and forth direction.

Optionally, a foot pedal is rigidly connected to each of the handlebars and extends rearward therefrom to below the seat, each foot pedal being individually moveable down and up by the legs of a user of the device to assist in raising and lowering the weights.

The weight platform preferably includes a shaft which extends upwardly from the platform for receiving conventional weight disks or plates, and may include shafts of varying diameter for receiving different configurations of weight disks or plates.

In another aspect, the present invention is directed to an exercise device that comprises a frame having a seat mounted thereon. A pair of handlebars extends upwardly from and pivotally attached to the frame at a point forward of the seat, each of the handlebars being individually moveable back and forth by the arms of a user of the device. A foot pedal is mounted to and extends rearwardly from each of the handlebars, each foot pedal being individually moveable down and up by the legs of a user of the device. The exercise device includes a pair of weight support frames, each of the frames having at least one vertically extending elongated member rigidly connected thereto. Each frame also includes a plurality of weights slidably mounted upon the elongated member. The exercise device further includes a linkage means between each of the handlebars and selected weights within a corresponding weight support frame. The linkage means permits the selected weights to be raised and lowered by respective back and forth movement of the handlebars. The user when seated on the seat may exercise his individual arms and/or legs against resistance of raising and lowering selected weights by respective movement of the individual handlebars in a back and forth direction and individual foot pedals in a down and up direction.

In a further aspect, the present invention is directed to an exercise device that comprises a frame having a seat mounted thereon. A pair of handlebars extends upwardly from and pivotally attached to the frame at a point forward of the seat. Each of the handlebars is individually moveable back and forth by the arms of the user of the exercise device. A foot pedal is mounted to each of the handlebars and extends rearward therefrom to below the seat. Each foot pedal is individually moveable down and up by the legs of the user of the device. The exercise device includes a single vertical weight support frame that has at least one vertically extending elongated member rigidly connected thereto. A plurality of weights is slidably mounted upon the elongated member. A linkage means between each of the handlebars and selected weights within the weight support frame permit the selected weights to be raised and lowered by respective back and forth movement of the handlebars. The user, when seated on the seat, may exercise his or her individual arms and/or legs against resistance of raising and lowering selected weights within the weight support frame by respective movement of the individual handlebars in a back and forth direction and individual foot pedals in a down and up direction.

BRIEF DESCRIPTION OF THE DRAWINGS

FIG. 2 is a sectional view of the device looking downward along lines 2—2 as shown in FIG. 1;

FIG. 3 is an elevational view of the front portion of the device as seen along lines 3—3 of FIG. 1;

FIG. 5 is a sectional view of the device looking downward along lines 5—5 as shown in FIG. 4;

FIG. 6 is an elevational view of the front portion of the device as seen along lines 6—6 of FIG. 4;

DESCRIPTION OF THE PREFERRED EMBODIMENTS

Figure 1:
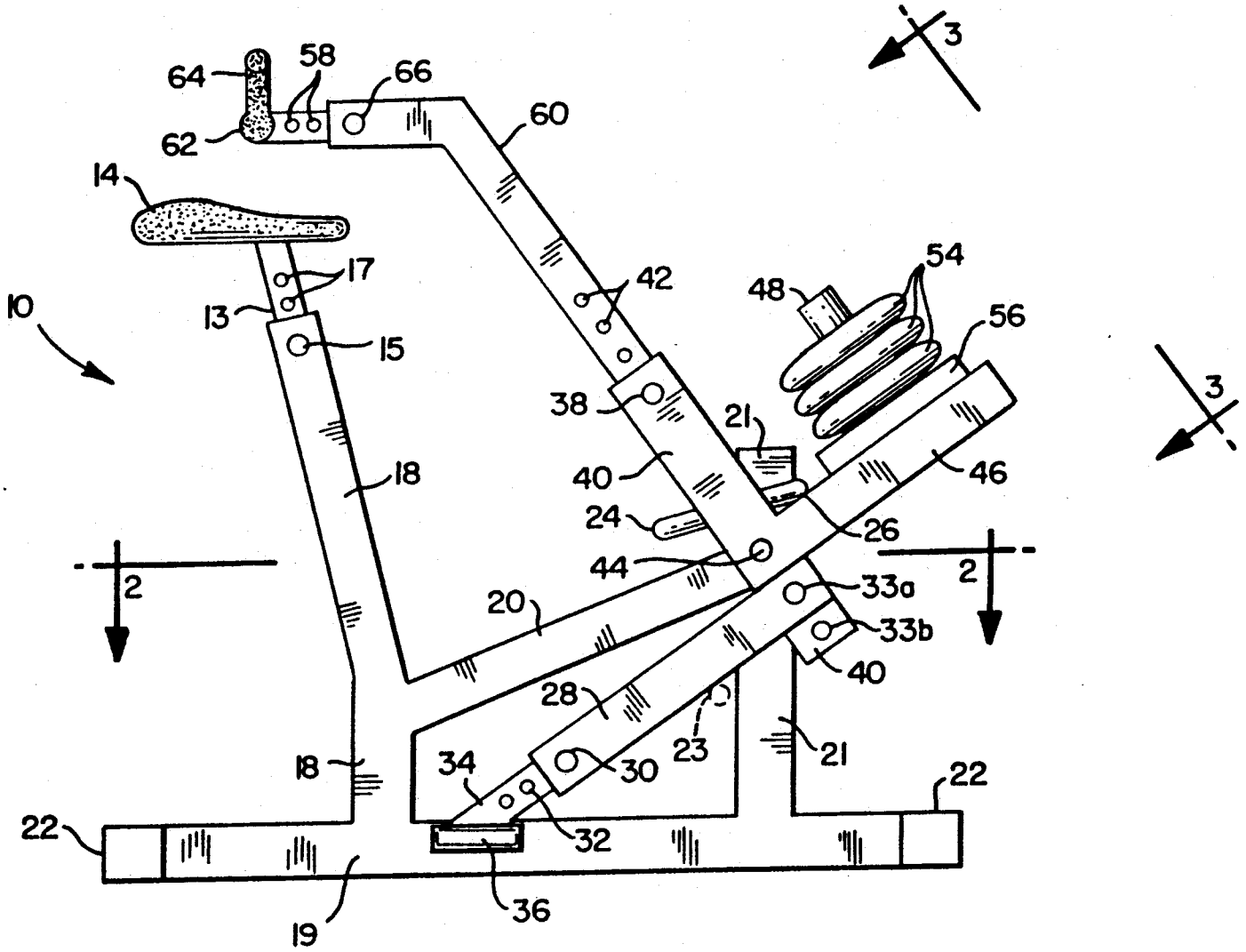
FIG. 1 is a side elevational view of one embodiment of the exercise device of the present invention.

One embodiment of the present invention is described herein with reference to drawing FIGS. 1–3 in which like numerals refer to like features of the invention. Features of the invention are not necessarily shown to scale. Unless otherwise noted, all features are made of rugged structural material such as steel, aluminum, or rigid plastic. For frame and other support members, square cross-section tubing is preferred.

The exercise device 10 consists generally of a lower longitudinal frame member 19 having transverse members or feet 22 at opposing ends thereof. Extending substantially vertically from the mid-section of member 19 is frame member 18 which at its upper end receives seat post 13 upon which a bicycle seat 14 is disposed. A plurality of spaced seat support holes 17 are provided through which seat support 15 pin may be placed in member 18 to adjust the height of the seat as desired. This provides bicycle-type seating to the user in which, as shown in FIG. 1, the user's body is facing to the right. As used herein, "bicycle-type seating" is used to refer to a relatively narrow seat, such as the type employed in conventional two wheel bicycles, on which the user sits and straddles with his legs in order to be able to move and exercise his arms and legs.

Extending upwards from frame 19 at a location forward of frame member 18 is vertical member or post 21. Frame member 20 connects a mid-section of member 21 with a mid-section of member 18 for increased rigidity of the frame. As seen best in FIGS. 2 and 3, a horizontal shaft or axle 44 extends outwardly on either side of post 21, being secured thereto by frame connector members 45. Shaft 44 is disposed below and forward of seat 14 and provides the pivot point around which the handlebars, foot pedals and weight platforms rotate or pivot in limited arcs, was will be further explained below.

Rotatably disposed on shaft 44 on the right side of exercise device 10 is an arm 40 and arm extension 60 which comprise the right side handlebar of the device. This handlebar extends generally upwardly and rearwardly from shaft 44, the extension length of which may be adjusted by insertion of pin 38 into a selected spaced hole 42 in arm extension 60. At the upper end of arm extension 60 and extending horizontally and rearwardly therefrom is the right handle which comprises a horizontal handle portion 62 and a vertical handle portion 64, the positions of which may be adjusted by insertion of handle support pin 66 through the desired spaced handle adjustment hole 58. A similar handlebar arrangement with identical features is provided on the left side of exercise device 10 in which arm 41 is pivotally connected at its lower end to shaft 44 and extends upwardly therefrom. An arm extension 61 is adjustable by pin 39 through adjustment holes 43. Horizontal and vertical handles 63 and 65, respectively, are adjustable with respect to the upper end of arm extension 61.

Extending forwardly away from and connected rigidly to each of the handlebars are right and left weight support members 46 and 47, respectively. Weight support members 46 and 47 are attached near the lower ends of arms 40 and 41, respectively, and extend generally forward and away from the arms and shaft. Weight support plates 56, 57 are provided on the weight support members. Extending vertically upward from weight support plates 56 and 57 are weight mounting shafts 48 and 49, respectively. The weight mounting shafts are adapted to receive the central openings of conventional weight plates or disks 54 of the type which are used on barbells or other weight equipment. Since each handlebar and associated weight support member moves independently of the other, the user may select the desired weight and number of individual weights 54 for each side of the device 10. As seen in side view, when each weight platform 56 or 57 is loaded with the desired number of weights, it may be independently raised and lowered in an arc around shaft pivot 44 upon respective back and forth movement of each of the handlebar assemblies.

Since home or professional type weights 54 may have different diameter openings, a larger diameter sleeve 50 may be provided to accommodate the various configurations of weight disks or plates. A pin 52 may be placed through an opening in the upper end of shaft 48, 49 to hold the weights 54 securely in place during use.

A foot pedal assembly is provided for each of the handlebars assemblies to enable the user's feet to move the weights up and down. As seen on the right side of device 10, foot bar 28 is rigidly connected to the handlebar assembly by attachment with fastener 33*a* near the lower end of arm 40. Alternatively, foot bar 28 may be positioned lower along arm 40 by connection with fastener 33*b*. Foot bar 28 extends generally rearwardly and downwardly and receives a foot pedal extension 34 upon which foot pedal 36 is mounted. A series of spaced adjustment holes 32 are formed in pedal extension 34 such that pin 30 may adjust the location of pedal 36 as desired by the user. Likewise, on the left side of device 10, foot bar 29 extends rearwardly and downwardly from rigid connection to the lower end of arm 41, and secures pedal extension 35, on which foot pedal 37 is mounted, at a desired location by pin 31.

To limit movement of each of the handlebars assemblies and associated weight support members and platforms between defined limits, U-shaped stop bars 24, 26 and 25, 27 are attached to the inner sides of arms 40 and 41 respectively. The respective arms 24, 26 and 25, 27 of the stop bars extend inwardly and contact the front and back sections of the upper end of frame member 21 when the forward and rear limits of movements of handlebars are reached. Alternatively, a stop bar 23 may be provided on foot bars 28, 29 to contact frame members 20 and 21 to limit movement of the foot bar and handlebar assemblies. Stop bars 23–27 may be covered by foam rubber sleeves in order to minimize noise and to prevent denting or deformation of the areas of frame member 21 that contact the stop bars.

In operation, the user sits atop seat 14 with legs straddling frame members 18 and 20 and places his right and left feet respectively on foot pedals 36 and 37. The user's right and left hands grip either horizontal handles 62, 63 or vertical handles 64, 65 respectively. Resistance against movement of the individual handlebars in a back and forth direction is provided by respectively raising and lowering each individual right and left weight platform with associated weight(s) mounted thereon. Alternatively, or in conjunction with movement of the handlebars, the individual foot pedals are moved in a down and up direction to raise and lower the weight platforms. Thus, the individual user may exercise his right arm and leg independently from his left arm and leg. Additionally, the user has a choice of exercising either his legs or arms alone or in conjunction with each other, as desired.

Figure 4:
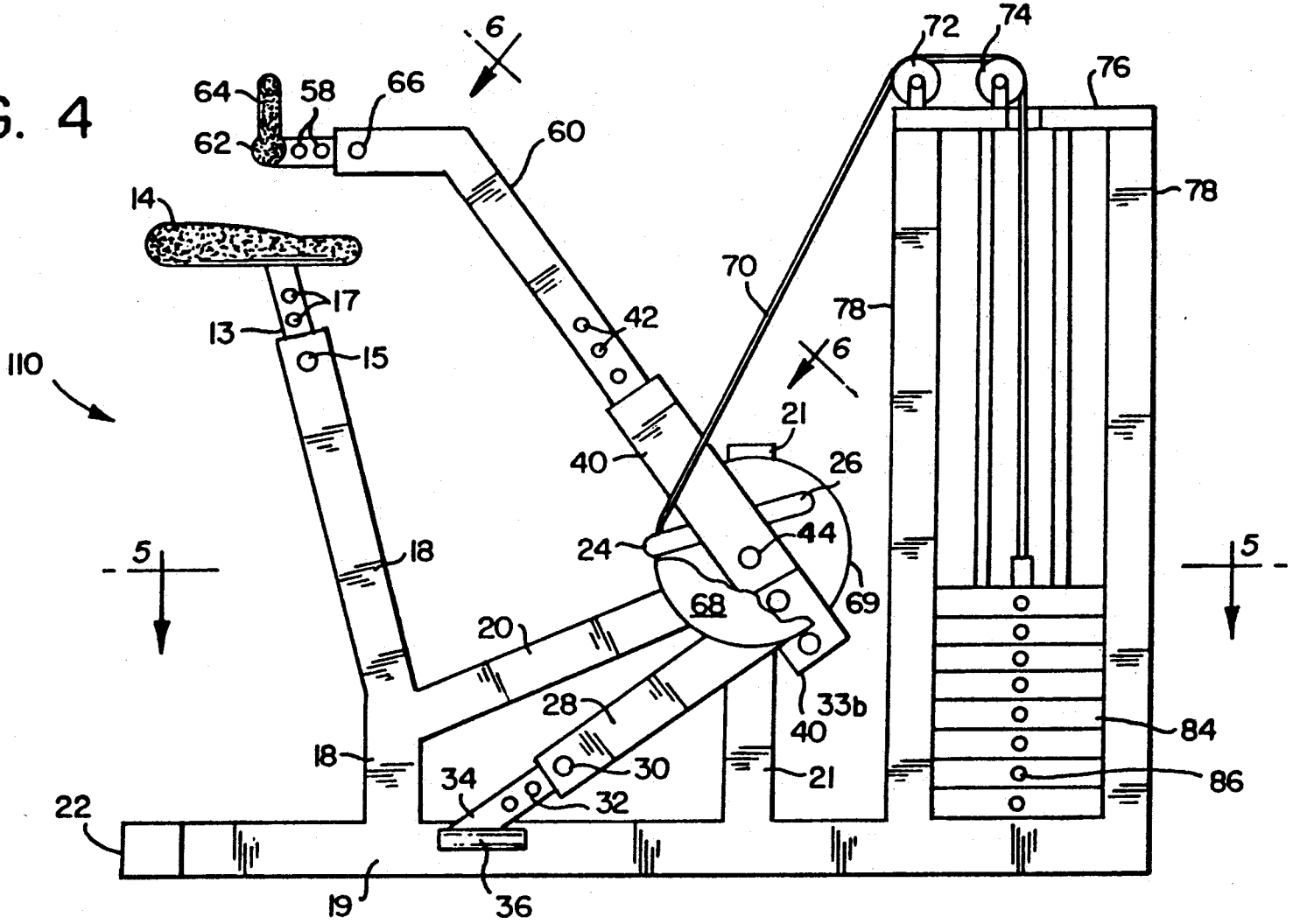
FIG. 4 is a side elevational view of an alternate embodiment of the exercise device of the present invention.

An alternate embodiment of the present invention is shown in FIGS. 4–11. Referring to FIGS. 4, 5, and 6, disk 68 is rotatably or pivotally disposed on shaft 44 on the right side of exercise device 110. Arm 40, which is rotatably disposed on shaft 44, is rigidly connected to disk 68 so that movement of arm 40 about shaft 44 produces movement of disk 68 about shaft 44. Similarly, movement of foot pedal 36 in a down or up direction will also produce movement of disk 68 about shaft 44. Stop bars 24, 26 limit the movement of disk 68 and hence arm 40, so that arm 40 and disk 68 pivot about shaft 44 in a limited arc. Referring to FIGS. 8*a* and 8*b*, disk 68 has concave groove 94 circumferentially formed in the disk edge for receiving belt or cable 70. Hollow shaft 88 is rigidly connected to disk 68 and is located over groove 94 in order to receive threaded end 112 of cable 70. Nuts 90 and 92 are removably secured to threaded end 112 of cable 70 and cooperate with hollow shaft 88 to retain threaded end 112 within hollow shaft 88 and to confine cable 70 substantially within groove 94. Hollow shaft 88, in conjunction with nuts 90 and 92, allow cable 70 to be adjusted so as to maintain a minimum tension on the cable and to allow stop bar 24 to lightly contact the back section of the upper end of frame member 21 when handlebar 40 is not being used. Disk 68 has an opening 106 located in the center thereof for receiving shaft 44. Locking washer 96 is utilized to retain disk 68 and arm 40 upon shaft 44.

Figure 9:
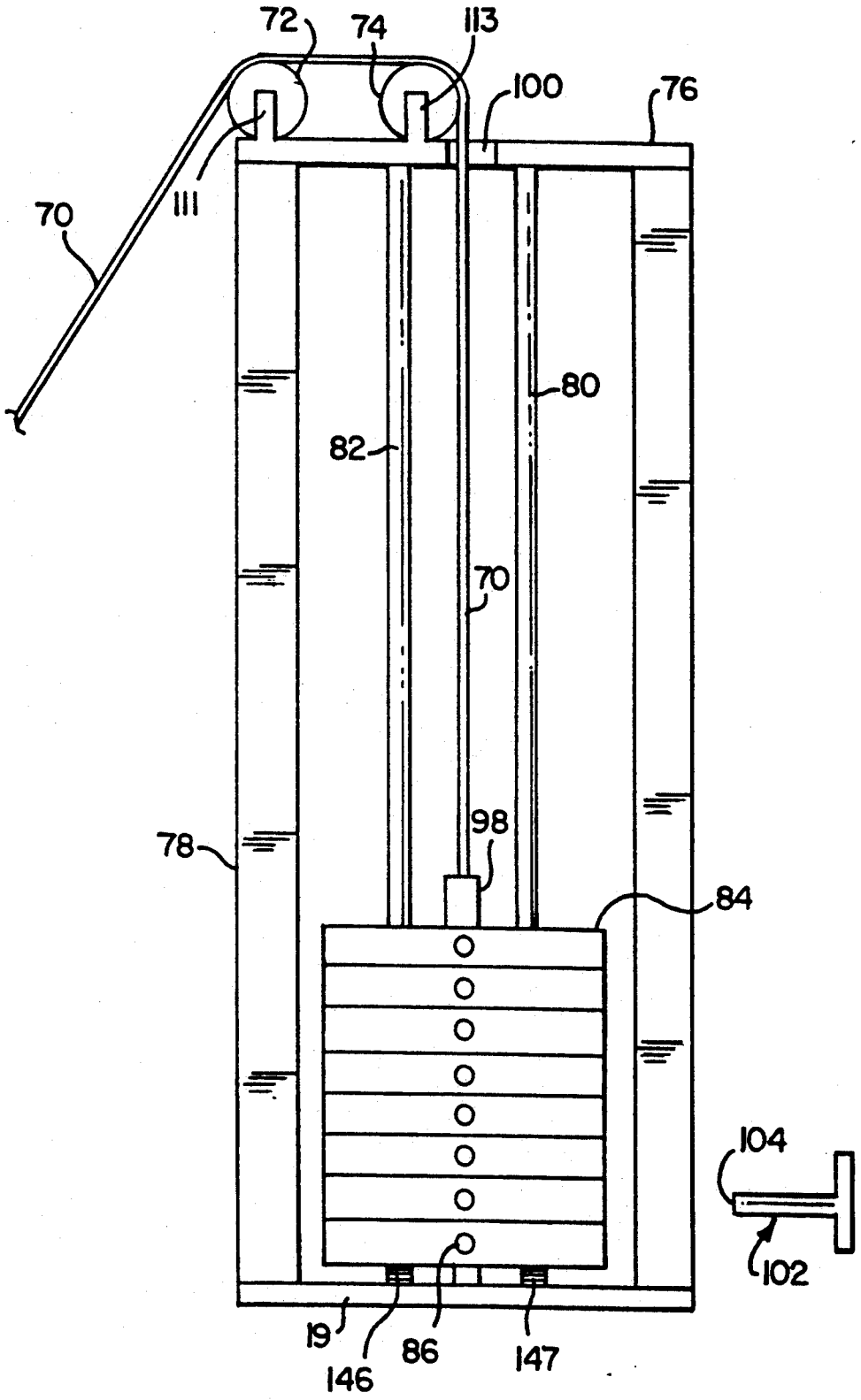
FIG. 9 is a front elevational view of the weight support frame depicted in FIG. 4.

Referring to FIGS. 4, 5 and 9, weight support frame 78 extends upwards from longitudinal frame 19. Elongated members 80 and 82 extend vertically within frame 78 and have top and bottom ends that are fixed to top end 76 and longitudinal frame 19, respectively. Each weight 84 has two openings therein for receiving elongated members 80 and 82 thereby allowing weights 84 to be slidably mounted upon members 80 and 82. Coiled springs 146 and 147 are placed over the ends of members 80 and 82 in order to absorb the impact of downward moving weight plates 84. Each weight 84 has a third opening therein, which is located between the two openings that receive the elongated members, for receiving weight attachment rod 98. Weight attachment rod 98 has a plurality of spaced weight support holes that are aligned with weight support pin holes 86 of weights 84. When the user inserts end 104 of weight support pin 102 into weight support pin hole 86 of an individual weight plate 84, end 104 protrudes into a corresponding weight support hole in weight attachment rod 98. Hence, the particular weight plate 84 having pin 102 inserted therein, and any weight plates 84 stacked on top of that particular weight plate, will be secured to rod 98 during use. As shown in FIG. 9, the end of weight attachment rod 98 that extends above weights 84 is rigidly connected to an end of cable 70. Cable 70 enters frame 78 through opening 100 in top end 76. When the user of the device moves handlebar 40 using either the hand grip or the foot pedal, cable 70 drivingly engages pulleys 72, 74. Pulleys 72, 74 are rotatably mounted on pulley mounts 111, 113, respectively, which are mounted on top end 76 of vertical weight support frame 78.

Figure 10:
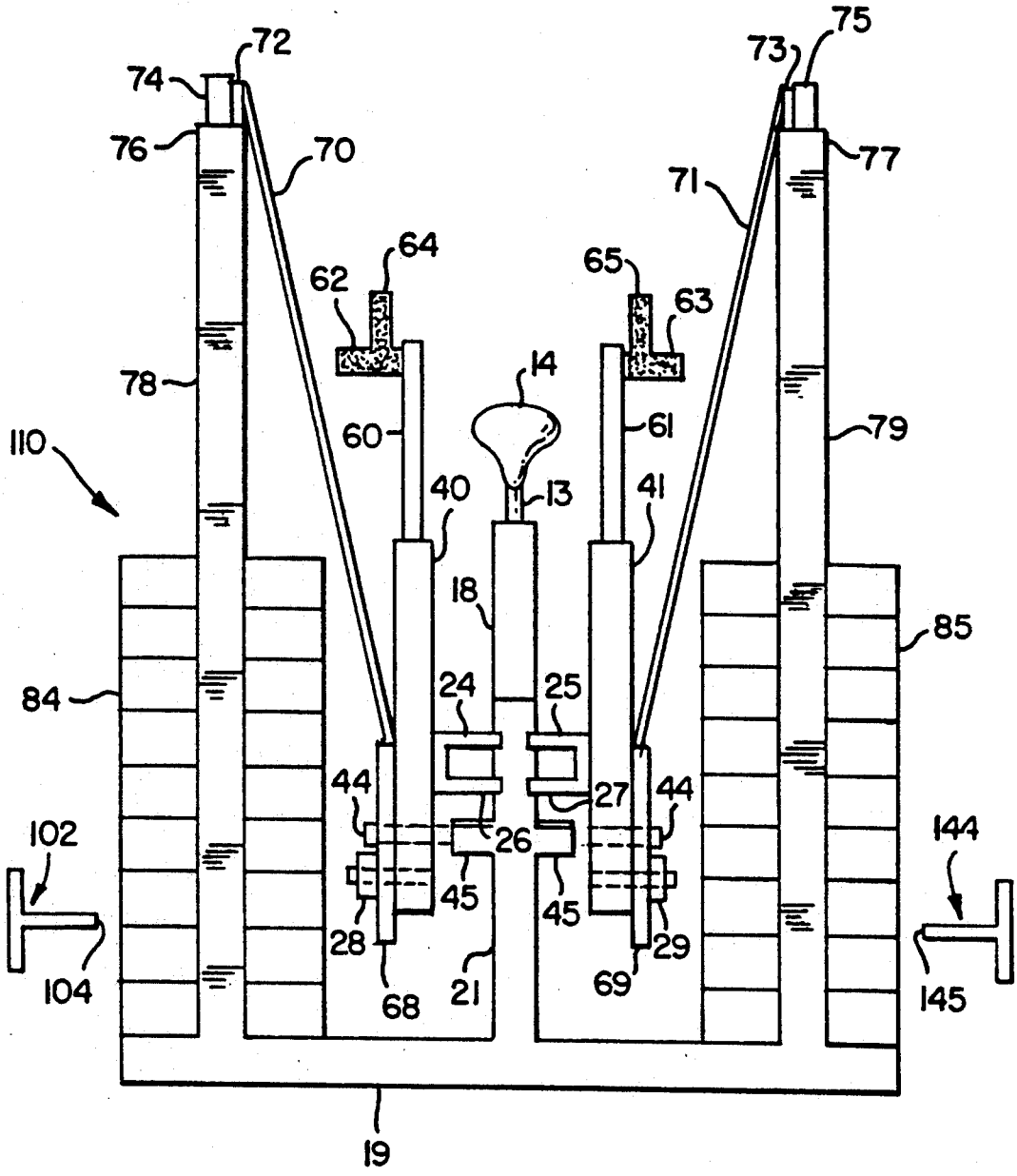
FIG. 10 is a front elevational view of the exercise device of FIG. 4.

Referring to FIGS. 5 and 10, the left side of exercise device 110 includes an identically constructed disk, cable and weight support frame assembly. Disk 69 is rotatably or pivotally disposed on shaft 44 on the left side of exercise device 110. Arm 41, which is rotatably disposed on shaft 44, is rigidly connected to disk 69 so that movement of arm 41 about shaft 44 produces movement of disk 69 about shaft 44. Similarly, movement of foot pedal 37 in a down or up direction will also cause disk 69 to pivot about shaft 44. Stop bars 25, 27 limit the movement of disk 69 and hence arm 41, so that arm 41 and disk 69 pivot about shaft 44 in a limited arc. Disk 69 has a concave groove (not shown) circumferentially formed in the edge thereof for receiving belt or cable 71. A hollow shaft (not shown) is rigidly connected to disk 69 and is located over the groove in order to receive a threaded end (not shown) of cable 71. Two nuts (not shown) are removably secured to the threaded portion of cable 71 and are located on either side of the hollow shaft of disk 69. The nuts and hollow shaft (of disk 69) cooperate to retain the threaded ends of cable 71 within the hollow shaft and to confine cable 71 substantially within the groove of disk 69. The hollow shaft, in conjunction with the nuts, allow cable 71 to be adjusted so as to maintain a minimum tension on the cable and to allow stop bar 25 to lightly contact the back section of the upper end of frame member 21 when handlebar 41 is not being used. Disk 69 has an opening (not shown) located in the center thereof for receiving shaft 44. A locking washer is utilized to retain disk 69 and arm 41 upon shaft 44.

Weight support frame 79 extends upward from longitudinal frame 19. Two (2) elongated members 83, 89 extend vertically within frame 79 and have top and bottom ends that are fixed to top end 77 and longitudinal frame 19, respectively. Each weight plate 85 has two (2) openings therein for receiving elongated members 83, 89 thereby allowing weights 85 to be slidably mounted upon members 83, 89. Coiled springs (not shown) are placed over the ends of members 83 and 89 in order to absorb the impact of downward moving weight plates 85. Each weight 85 has a third opening therein, which is located between the two openings that receive the elongated members 83, 89, for receiving a weight attachment rod 87. Weight attachment rod 87 has a plurality of spaced weight support holes that are aligned with corresponding weight support pin holes (not shown) of weights 85. When the user inserts end 145 of weight support pin 144 into a weight support pin hole of an individual weight plate 85, end 145 protrudes into a corresponding weight support hole in weight attachment rod 87. Hence, the particular weight plate 85 having pin 144 inserted therein, and any weight plates 85 stacked on top of that particular weight plate, will be secured to rod 87 during use. The end of weight attachment rod 87 that extends above weights 85 (similar to rod 98 in FIG. 9) is rigidly fixed to an end of cable 71. Cable 71 enters frame 79 through an opening (not shown) in top end 77. When the user of the device moves handlebar 41 using either the hand grip or the foot pedal, cable 71 drivingly engages pulleys 73, 75. Pulleys 73, 75 are rotatably mounted to respective pulley mounts which are mounted on top end 77 of vertical weight support frame 79.

Resistance against movement of handlebars 40, 41 in a back and forth direction is provided by respectively raising and lowering selected weights 84, 85 that are secured to the weight attachment rods 98 and 87, respectively. Since each handlebar moves independently of the other, the user may select the desired weight and number of weight plates for each side of device 110.

Figure 7:
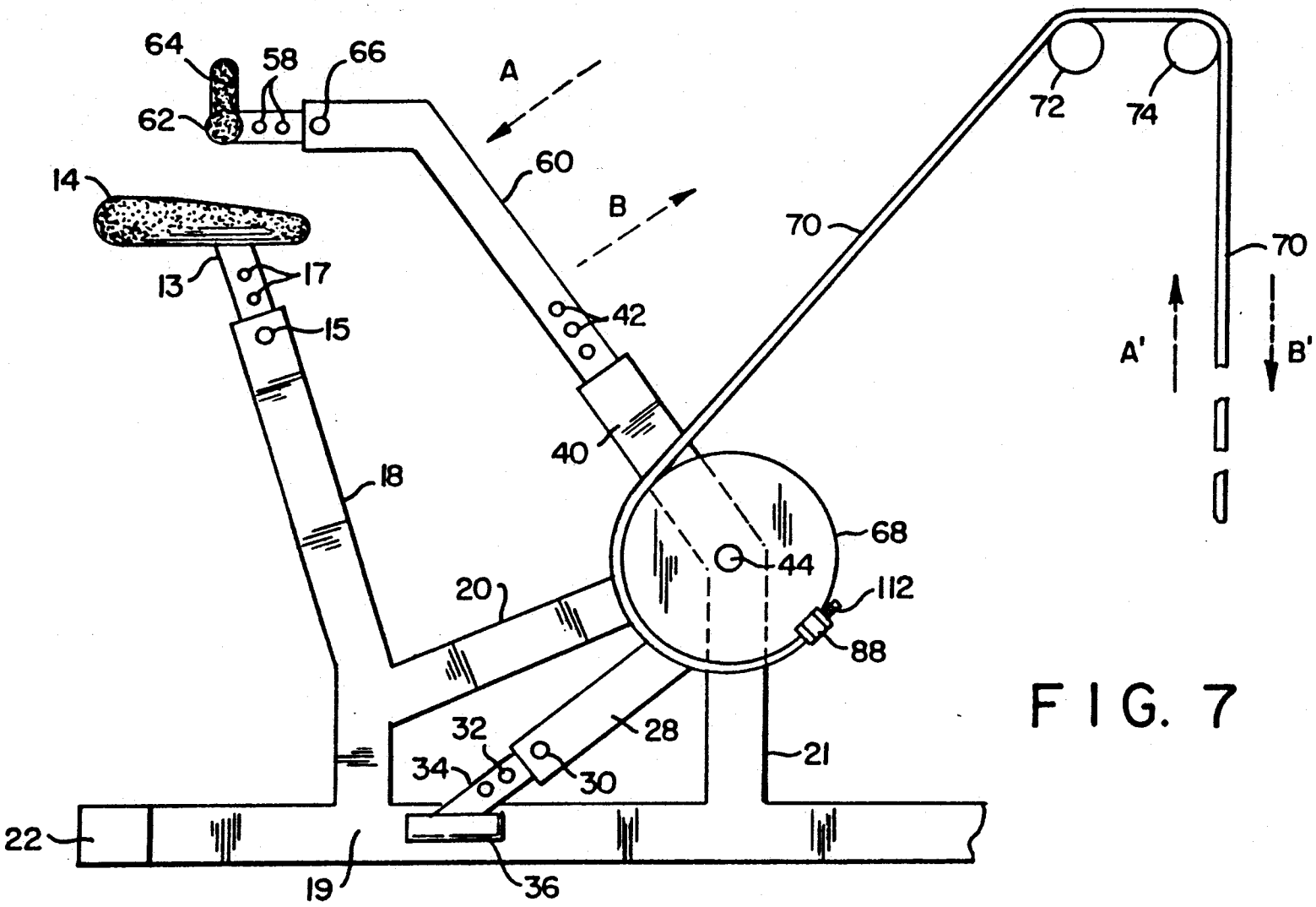
FIG. 7 is a partial, side elevational view of the exercise device of FIG. 4.

As shown in FIG. 7, when the user of exercise device 110 moves handlebars 40, 41 in the direction designated by the letter A, selected weights 84 and 85 move in the direction designated by A'. Conversely, when the user moves handlebars 40, 41 in the direction designated by letter B, the selected weights move in the direction designated by B'.

Figure 8A:
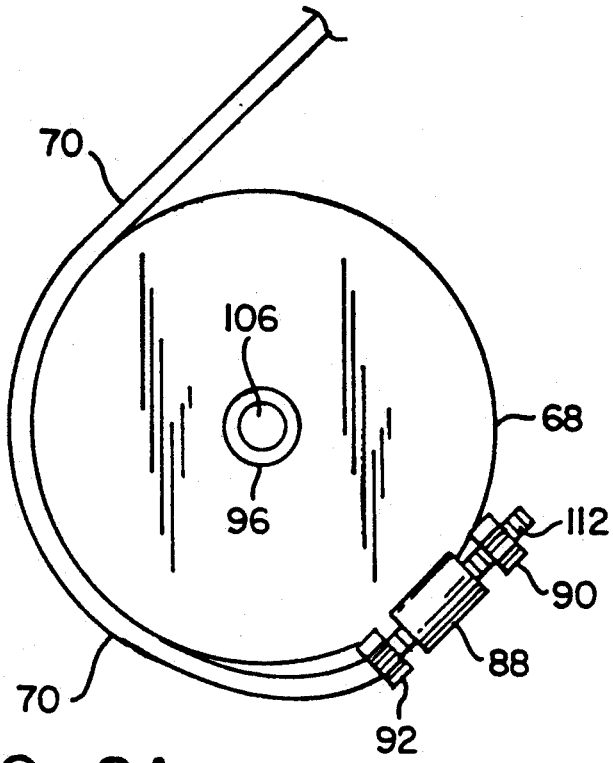
FIG. 8*a* is a side elevational view of a circular disk utilized in the exercise device of FIG. 4.
Figure 8B:
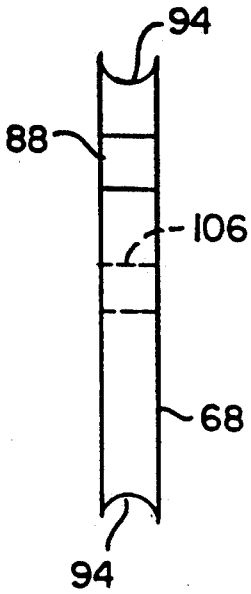
FIG. 8*b* is a front elevational view of the disk of FIG. 8*a;*
Figure 11:
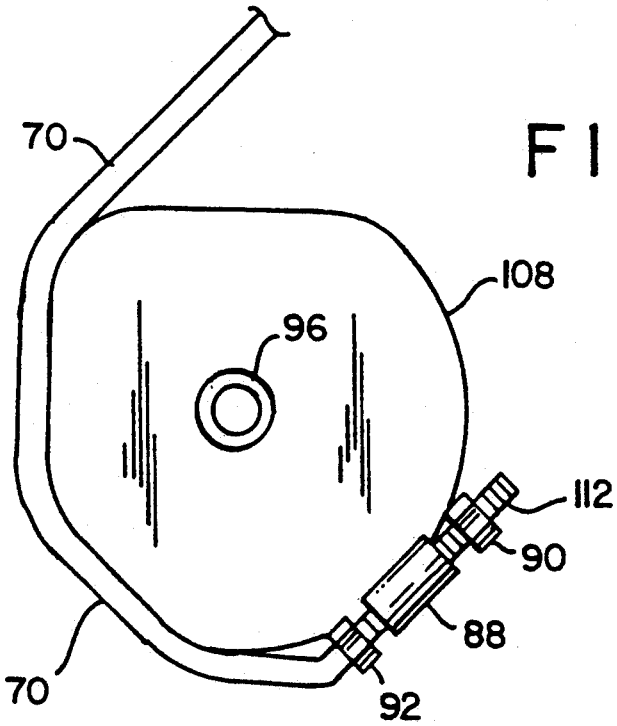
FIG. 11 is a side elevational view of an oblong disk utilized in the exercise device of FIG. 4.

The shape of each disk is substantially circular, as shown in FIG. 8*a*. As an alternative, the disks may be oblong or noncircular, as shown by disk 108 in FIG. 11, and may be mounted eccentrically. Oblong disk 108 has a perimeter that is greater than the circumference of circular disks 68, 69, thereby providing an increased "pulling distance." As used herein, the term "pulling distance" refers to the height, within each weight support frame, to which selected weights can be lifted. Hence, in order to raise selected weights to a maximum height within the respective weight support frame, the user need not depress handlebars 40, 41 as far as he or she would have to if using the circular-shaped disks. The user may also use a combination of both disks whereby an oblong disk is used on one side of the exercise device and a circular disk is used on the other side.

Figure 12A:
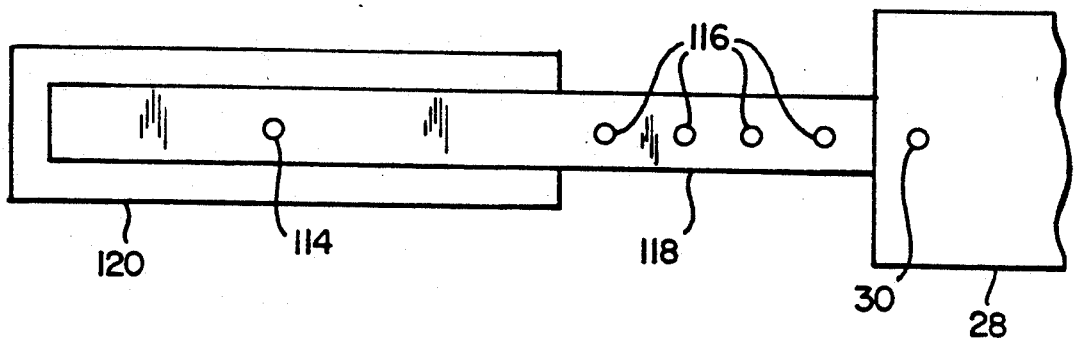
FIG. 12*a* is a side elevational view of an alternate pedal assembly.
Figure 12B:
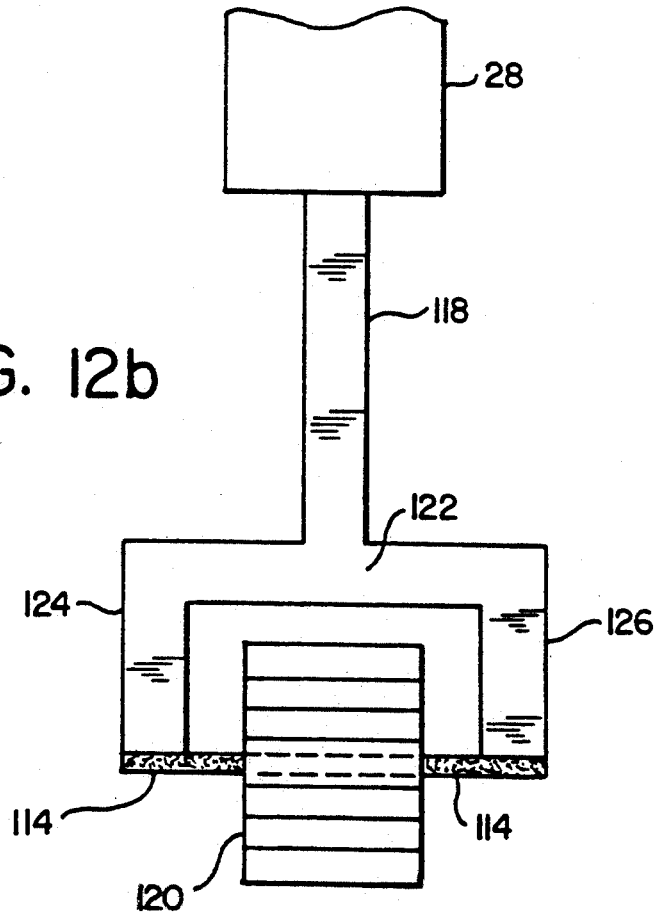
FIG. 12*b* is a top plan view of the pedal assembly of FIG. 12*a*.

FIGS. 12*a* and 12*b* show an alternate pedal assembly which can also be utilized on exercise device 110. Foot bar 28 extends generally rearwardly and downwardly and receives foot pedal extension 118. End 122 of extension 118 comprises arms 124 and 126. Shaft 114 is rigidly fixed between arms 124 and 126 and has pedal 120 pivotally mounted thereon. A series of spaced adjustment holes 116 are formed in pedal extension 118 such that pin 30 may adjust the location of pedal 120 as desired by the user. Since pedal 120 is able to pivot upon shaft 114, the user's foot and ankle do not undergo unnecessary stress and strain while moving arm 40 thereby assisting the user in keeping his or her foot positioned on pedal 120. An identical pedal assembly is received by foot bar 29 on the left side of exercise device 110.

Figure 13:
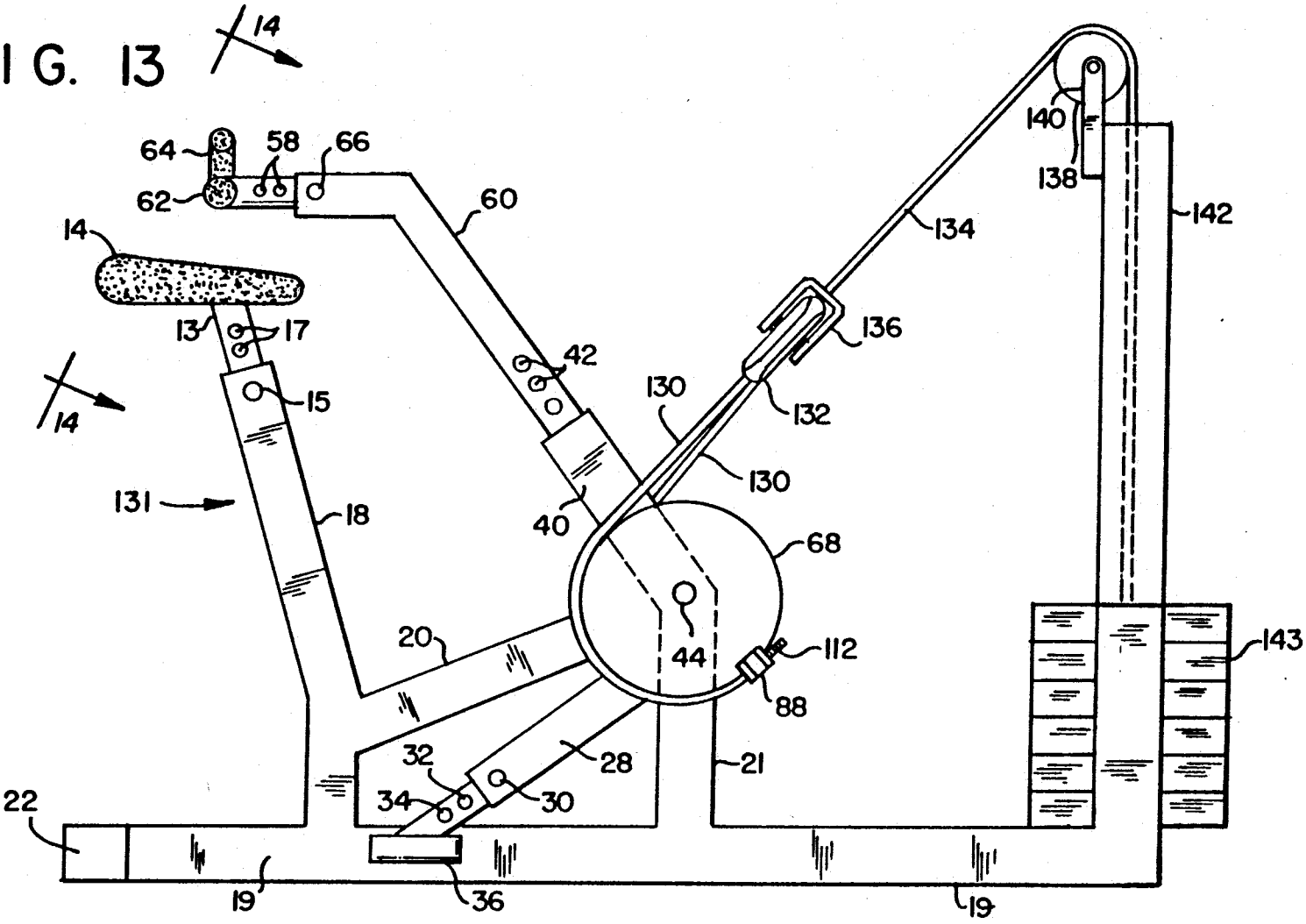
FIG. 13 is a side elevational view of a further embodiment of the exercise device of the present invention.
Figure 14:
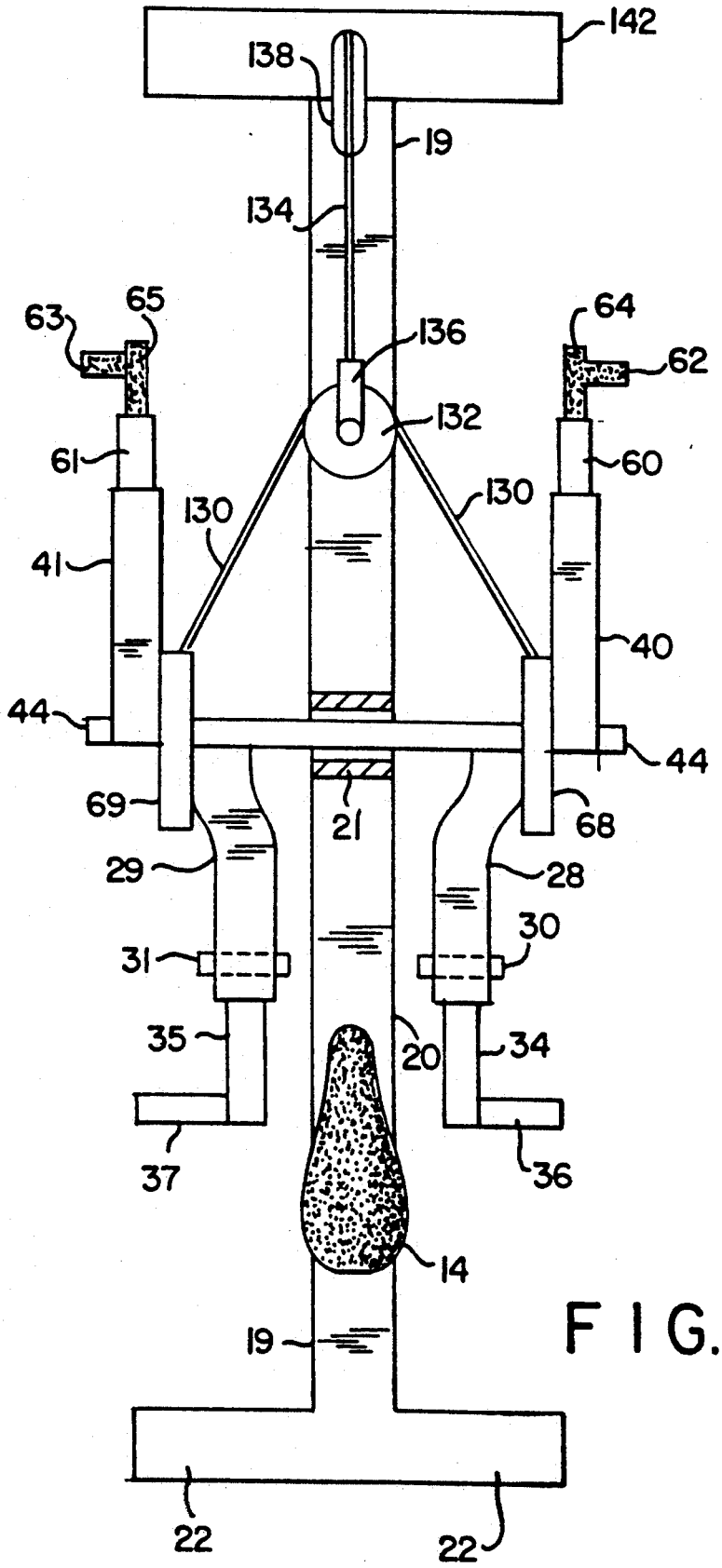
FIG. 14 is a view of the exercise device looking downwards as seen along lines 14—14 of FIG. 13.

FIG. 13 shows a further embodiment of the exercise device of the present invention. Exercise device 131 utilizes a single weight support frame 142 which is structurally integral with longitudinal frame 19. Weights 143 are slidably mounted upon a vertically extending elongated member (not shown) that is rigidly fixed to weight support frame 142. Pulley 140 is rotatably mounted to pulley mount 138, which is rigidly connected to frame 142. Cable 134 has one end rigidly connected to the weight attachment rod (not shown) that is associated with weights 143, and a second end that is rigidly connected to bracket 136. Bracket 136 is pivotally mounted to pulley 132, which is drivingly engaged with cable 130. A hollow shaft and nut assembly, identical in construction to hollow shaft 88 and nuts 92 and 94, are utilized on each disk 68, 69 for removably securing to each disk a threaded end (not shown) of cable 130. The nuts and hollow shaft of each disk cooperate to confine cable 130 substantially within the groove of each disk. The nut and hollow shaft assembly of each disk also cooperate to maintain a minimum tension on cable 130 and to allow stop bars 24 and 25 to lightly contact the back section of the upper end of frame 21 when handlebars 40, 41 are not being used. As shown in FIG. 14, disk 68 is pivotally mounted on shaft 44 and is located between arm 40 and foot bar 28. Similarly, disk 69 is pivotally mounted on shaft 44 and is located between arm 41 and foot bar 29. Pulley 132, while being drivingly engaged with cable 130, moves downward or upward in response to respective back and forth movement of either or both handlebars 40, 41. Thus, selected weights attached to the weight attachment rod are raised and lowered by respective back and forth movement of handlebars 40, 41. The alternate pedal assembly, as shown in FIGS. 12*a* and 12*b*, may also be utilized on exercise device 131.

One advantage of exercise device 131 is the reduction of manufacturing costs realized due to the utilization of only one weight support frame.

In a preferred embodiment, weight support frames 78, 79 and 142 are structurally integral with longitudinal frame 19. Frames 78, 79 and 142, however, can also be separate individual structures. It is also preferred that the stop bars utilized to limit the movement of the handlebars be mounted on the inner sides of handlebars 40, 41, as shown by stop bars 24, 26 and 25, 27 in FIG. 10. However, stop bars can also be mounted on the inner sides of disks 68 and 69.

Thus, the present invention meets the objects recited above and provides a simple, easy-to-manufacture bicycle type exercise device in which the users arms and legs may be individually exercised against the resistance of raising and lowering selected weights.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. An exercise device comprising:

a frame having a seat mounted thereon;

a pair of handlebars extending upwardly from and pivotally attached to said frame at a point forward of said seat, each of said handlebars being individually moveable back and forth by the arms of a user of said device;

a foot pedal mounted to and extending rearwardly from each of said handlebars, each foot pedal being individually moveable down and up by the legs of a user of said device;

a pair of weight support frames, each of which having at least one vertically extending elongated member rigidly connected thereto, each of said frames having a plurality of weights slidably mounted upon said elongated member;

a linkage means between each of said handlebars and selected weights within a corresponding one of said weight support frames, said linkage means permitting said selected weights to be raised and lowered by respective back and forth movement of said handlebars;

whereby said user seated on said seat may exercise his individual arms and/or legs against resistance of raising and lowering said selected weights by respective movement of the individual handlebars in a back and forth direction and individual foot pedals in a down and up direction.

2. The exercise device of claim 1 wherein said handlebar pivot point is below and forward of said seat.

3. The exercise device of claim 1 further including means on said frame for limiting movement of each of said handlebars between defined forward and rear limits.

4. The exercise device of claim 1 wherein each of said foot pedals is pivotally mounted to a corresponding one of said handlebars.

5. The exercise device of claim 4 wherein said linkage means comprises:

a pair of disks, each of which being pivotally attached to said frame at said pivot point and rigidly connected to a corresponding one of said handlebars, each of said disks having a circumferentially-formed groove in the edge thereof;

a pair of weight attachment rods, each of which being associated with a corresponding plurality of weights, each rod having a plurality of spaced weight support holes through which a weight support pin may be placed to secure said selected weights thereto;

a pair of cables, each of which having first and second ends;

a securing means on each of said disks for removably securing thereto said first end of a corresponding one of said cables, said first end of said corresponding cable being secured in such a manner that the portion of said corresponding cable that engages said disk is confined substantially within said groove, said second end of each of said cables being rigidly connected to a corresponding one of said weight attachment rods; and at least one pulley mounted to each of said weight support frames, said pulley being drivingly engaged with a corresponding one of said cables.

6. The exercise device of claim 5 wherein each of said securing means maintains a minimum tension on a corresponding one of said cables.

7. The exercise device of claim 5 wherein the shape of each of said disks is substantially circular.

8. The exercise device of claim 5 wherein the shape of each of said disks is oblong.

9. An exercise device comprising:

a frame having a seat mounted thereon;

a pair of handlebars extending upwardly from and pivotally attached to said frame at a point forward of and below said seat, each of said handlebars being individually moveable back and forth by the arms of a user of said device;

means on said frame for limiting movement of each of said handlebars between defined forward and rear limits;

a pair of vertical weight support frames, each of which having a top and bottom end, each of said frames having at least one vertically extending elongated member rigidly connected thereto, each of said frames having a plurality of weights slidably mounted upon said elongated member;

a foot pedal mounted to each of said handlebars and extending rearward therefrom to below said seat, each foot pedal being individually moveable down and up by the legs of a user of said device;

a pair of weight attachment rods, each of which being associated with a corresponding plurality of weights, each rod having a plurality of spaced weight support holes through which a weight support pin may be placed to secure selected weights thereto; and a linkage means between each of said handlebars and a corresponding one of said weight attachment rods, said linkage means permitting said selected weights secured to said corresponding rod to be raised and lowered by respective back and forth movement of said handlebars;

whereby said user seated on said seat may exercise his individual arms and/or legs against resistance of raising and lowering selected weights that are secured to each of said weight attachment rods by respective movement of the individual handlebars in a back and forth direction and individual foot pedals in a down and up direction.

10. The exercise device of claim 9 wherein each of said foot pedals is pivotally mounted to a corresponding one of said handlebars.

11. The exercise device of claim 9 wherein said linkage means comprises:

a pair of disks, each of which being pivotally attached to said frame at said pivot point and rigidly connected to a corresponding one of said handlebars, each of said disks having a circumferentially-formed groove in the edge thereof;

a pair of cables, each of which having first and second ends;

a securing means on each of said disks for removably securing thereto said first end of a corresponding one of said cables, said first end of said corresponding cable being removably secured to a corresponding disk in such a manner that the portion of said corresponding cable that engages said corresponding disk is confined substantially within said groove, said second end of each of said cables being rigidly attached to a corresponding weight attachment rod; and at least one pulley mounted to said top end of each of said weight support frames, said pulley being drivingly engaged with a corresponding one of said cables.

12. The exercise device of claim 11 wherein the shape of each of said disks is substantially circular.

13. The exercise device of claim 11 wherein the shape of each of said disks is oblong.

14. The exercise device of claim 11 wherein each of said securing means maintains a minimum tension on a corresponding one of said cables.

15. An exercise device comprising:

a frame having a seat mounted thereon;

a pair of handlebars extending upwardly from and pivotally attached to said frame at a point forward of said seat, each of said handlebars being individually moveable back and forth by the arms of a user of said device;

a foot pedal mounted to and extending rearwardly from each of said handlebars, each foot pedal being individually moveable down and up by the legs of a user of said device;

a vertical weight support frame, said frame having at least one vertically extending elongated member rigidly connected thereto, said frame having a plurality of weights slidably mounted upon said elongated member; and a linkage means between each of said handlebars and selected weights within said weight support frame, said linkage means permitting said selected weights to be raised and lowered by respective back and forth movement of said handlebars;

whereby said user seated on said seat may exercise his individual arms and/or legs against resistance of raising and lowering said selected weights within said weight support frame by respective movement of the individual handlebars in a back and forth direction and individual foot pedals in a down and up direction.

16. The exercise device of claim 15 wherein said linkage means comprises:

a pair of disks, each of which being pivotally attached to said frame at said pivot point and rigidly connected to a corresponding one of said handlebars, each of said disks having a circumferentially-formed groove in the edge thereof;

a first cable having first and second ends, said first end of said first cable being removably secured to one of said disks, said second end of said first cable being removably secured to said other of said disks, said first and second ends of said first cable being removably secured to said disks in such a manner that the portions of said first cable that engage said disks are confined substantially within said grooves of said disks;

a weight attachment rod, said rod being associated with said plurality of weights, said rod having a plurality of spaced weight support holes through which a weight support pin may be placed to secure said selected weights thereto;

a first pulley drivingly engaged with said first cable and located between said disks;

a second cable having first and second ends, said first ends of said second cable being rigidly connected to said weight attachment rod;

means for securing said second end of said second cable to said first pulley, said securing means being pivotally attached to said first pulley; and a second pulley mounted to said weight support frame and drivingly engaged with said second cable.

17. The exercise device of claim 15 wherein said handlebar pivot point is below and forward of said seat.

18. The exercise device of claim 15 further including means on said frame for limiting movement of each of said handlebars between defined forward and rear limits.

19. The exercise device of claim 15 wherein each of said foot pedals is pivotally mounted to a corresponding one of said handlebars.

20. The exercise device of claim 16 wherein the shape of each of said disks is substantially circular.

21. The exercise device of claim 16 wherein the shape of each of said disks is oblong.

* * * * *